US012392007B2

(12) United States Patent
Hirashima et al.

(10) Patent No.: US 12,392,007 B2
(45) Date of Patent: Aug. 19, 2025

(54) HIGH STRENGTH STEEL SHEET, HIGH STRENGTH MEMBER, AND METHODS FOR MANUFACTURING THE SAME

(71) Applicant: JFE Steel Corporation, Tokyo (JP)

(72) Inventors: Takuya Hirashima, Tokyo (JP); Yu Hashimoto, Tokyo (JP); Shinjiro Kaneko, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 788 days.

(21) Appl. No.: 17/630,243

(22) PCT Filed: Jul. 29, 2020

(86) PCT No.: PCT/JP2020/029050
§ 371 (c)(1),
(2) Date: Jan. 26, 2022

(87) PCT Pub. No.: WO2021/020439
PCT Pub. Date: Feb. 4, 2021

(65) Prior Publication Data

US 2022/0282353 A1 Sep. 8, 2022

(30) Foreign Application Priority Data

Jul. 31, 2019 (JP) ..... 2019-140373

(51) Int. Cl.
*C21D 9/50* (2006.01)
*C21D 6/00* (2006.01)
(Continued)

(52) U.S. Cl.
CPC ..... *C21D 9/50* (2013.01); *C21D 6/004* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2014/0352850 A1* 12/2014 Kondo ..... C23C 2/40
148/504
2015/0017472 A1 1/2015 Kimura et al.
(Continued)

FOREIGN PATENT DOCUMENTS

CN 107250406 A 10/2017
CN 109154045 A 1/2019
(Continued)

OTHER PUBLICATIONS

Chinese Office Action with Search Report for Chinese Application No. 202080055524.4, dated Apr. 26, 2022, 11 pages.
(Continued)

*Primary Examiner* — Xiaowei Su
(74) *Attorney, Agent, or Firm* — Buchanan Ingersoll & Rooney PC

(57) ABSTRACT

The high strength steel sheet of the present invention has a specific chemical composition, and contains, in terms of area fraction relative to an entire steel microstructure, 30% or more and 100% or less ferrite, 0% or more and 70% or less martensite, and less than 20% in total of pearlite, bainite and retained austenite, and the ferrite contains, in terms of area fraction relative to an entire microstructure, 0% or more and 10% or less non-recrystallized ferrite, with a difference of the area fraction of the non-recrystallized ferrite in the longitudinal direction of the steel sheet of 5% or smaller.

12 Claims, 1 Drawing Sheet

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C23C 2/02*** | (2006.01) |
| ***C23C 2/26*** | (2006.01) |
| ***C23C 2/28*** | (2006.01) |

(52) U.S. Cl.

CPC ..... *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 2/02* (2013.01); *C23C 2/022* (2022.08); *C23C 2/26* (2013.01); *C23C 2/28* (2013.01); *C21D 2211/001* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | |
|---|---|---|---|
| 2015/0027594 | A1 | 1/2015 | Kawamura et al. |
| 2017/0211164 | A1 | 7/2017 | Kimura et al. |
| 2018/0171459 | A1 | 6/2018 | Drillet et al. |
| 2019/0177810 | A1 | 6/2019 | Kondo et al. |
| 2020/0299797 | A1 | 9/2020 | Kohsaka et al. |

FOREIGN PATENT DOCUMENTS

| | | | |
|---|---|---|---|
| EP | 2757171 | A1 | 7/2014 |
| EP | 2762580 | A1 | 8/2014 |
| EP | 2762581 | A1 | 8/2014 |
| EP | 3263727 | A1 | 1/2018 |
| JP | 2004197119 | A | 7/2004 |
| JP | 2005226081 | A | 8/2005 |
| JP | 2018016873 | A | 2/2018 |
| WO | 2013073136 | A1 | 5/2013 |
| WO | 2013114850 | A1 | 8/2013 |
| WO | 2013121953 | A1 | 8/2013 |
| WO | 2016198940 | A2 | 12/2016 |
| WO | 2017169869 | A1 | 10/2017 |

OTHER PUBLICATIONS

Extended European Search Report for European Application No. 20 847 790.1, dated Apr. 12, 2022, 12 pages.

Chinese Office Action for Chinese Application No. 202080055524.4, dated Nov. 14, 2022 with Concise Statement of Relevance of Office Action, 7 pages.

European Communication pursuant to Article 94(3) for European Application No. 20 847 790.1, dated May 9, 2023, 4 pages.

International Search Report and Written Opinion for International Application No. PCT/JP2020/029050, dated Oct. 20, 2020, 5 pages.

* cited by examiner

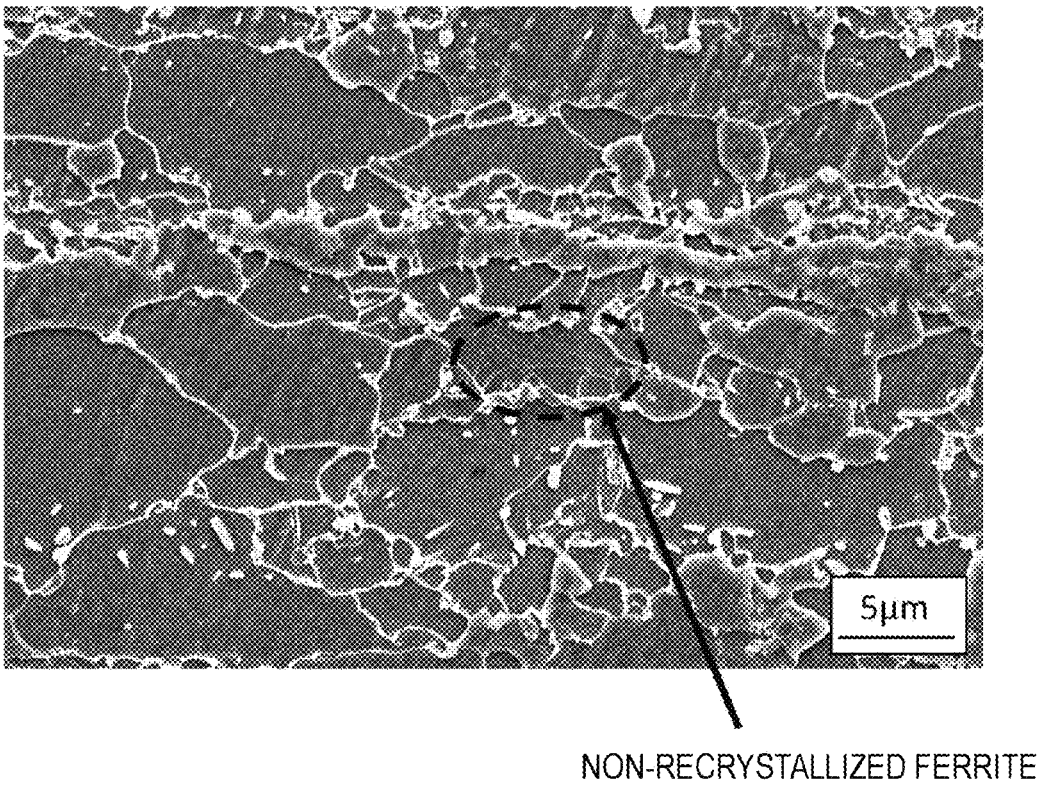
5μm
NON-RECRYSTALLIZED FERRITE

HIGH STRENGTH STEEL SHEET, HIGH STRENGTH MEMBER, AND METHODS FOR MANUFACTURING THE SAME

CROSS REFERENCE TO RELATED APPLICATIONS

This is the U.S. National Phase application of PCT/JP2020/029050, filed Jul. 29, 2020 which claims priority to Japanese Patent Application No. 2019-140373, filed Jul. 31, 2019 the disclosures of these applications being incorporated herein by reference in their entireties.

FIELD OF THE INVENTION

The present invention relates to a high strength steel sheet and a high strength member used for automotive parts and so forth, and methods for manufacturing the same. In more detail, the present invention relates to a high strength steel sheet and a high strength member having excellent material uniformity, and methods for manufacturing the same.

BACKGROUND OF THE INVENTION

In recent years, efforts have been directed to reducing emission gas such as $CO_2$ from the viewpoint of global environmental protection. Automotive industry has been taking measures of reducing volume of emission gas, by reducing automotive body weight thus improving fuel efficiency. One technique for reducing automotive body weight is exemplified by thinning of steel sheet used for automobile, through enhancement of strength. Steel sheet has however been known to degrade ductility as the strength improves, raising a need for a steel sheet well balanced between high strength and ductility. Moreover, the steel sheet whose mechanical property varies in the longitudinal direction will degrade reproducibility of shape fixation, thus degrading reproducibility of the amount of springback, and making it difficult to keep shape of parts. There is therefore a need for steel sheet that is free of variation in mechanical property in the longitudinal direction of the steel sheet, and excels in material uniformity.

In response to such need, for example, Patent Literature 1 proposes a high strength steel sheet that contains, in mass %, C: 0.05 to 0.3%, Si: 0.01 to 3%, and Mn: 0.5 to 3%, with a volume fraction of ferrite of 10 to 50%, a volume fraction of martensite of 50 to 90%, a volume fraction of total of ferrite and martensite of 97% or larger, and the steel sheet having a small variation in strength in the longitudinal direction of the steel sheet, as a result of controlling a difference of coiling temperature between a front end part and a center part of the steel sheet to 0° C. or larger and 50° C. or smaller, and controlling a difference of coiling temperature between a rear end part and the center part of the steel sheet to 50° C. or larger and 200° C. or smaller.

Patent Literature 2 proposes a hot rolled steel sheet having a chemical composition that contains, in mass %, C: 0.03 to 0.2%, Mn: 0.6 to 2.0%, and Al: 0.02 to 0.15%, with a volume fraction of ferrite of 90% or larger, and the steel sheet having a small variation in strength in the longitudinal direction of the steel sheet, as a result of controlling cooling after coiling.

PATENT LITERATURE

Patent Literature 1: JP 2018-16873 A
Patent Literature 2: JP 2004-197119 A

SUMMARY OF THE INVENTION

According to the technique disclosed in Patent Literature 1, excellent material uniformity is attained by a ferrite-martensite microstructure, and by controlling the coiling temperature so as to reduce microstructural difference in the longitudinal direction of the steel sheet. There however remains a problem of large variation in yield strength.

According to the technique disclosed in Patent Literature 2, variation in strength in the longitudinal direction of the steel sheet is reduced by employing ferrite as a dominant phase, and by controlling the composition and cooling before coiling. There is, however, no addition of precipitation elements such as Nb or Ti, so that the aforementioned reduction of variation in strength is different in conception from aspects of the present invention that relies upon control of variation in area fraction of non-recrystallized ferrite in the longitudinal direction of the steel sheet to which the precipitation elements are added.

It is therefore an object according to aspects of the present invention to provide a high strength steel sheet and a high strength member and methods for manufacturing the same, all aimed at improving material uniformity, by properly adjusting the chemical composition in the presence of added precipitation element such as Nb or Ti that can affect precipitation hardening to achieve high yield ratio, and by creating a ferrite-martensite microstructure to control variation in area fraction of non-recrystallized ferrite in the longitudinal direction of the steel sheet.

The present inventors conducted extensive studies aiming at solving the issue mentioned above. The present inventors consequently found that addition of Nb or Ti is necessary to achieve high strength as well as high yield ratio, and also that difference between the maximum value and minimum value of the area fraction of non-recrystallized ferrite in the longitudinal direction of the steel sheet is necessarily controlled to 5% or smaller, in order to reduce variation in the mechanical property in the longitudinal direction of the steel sheet.

As described above, the present inventors found, after our thorough investigations aimed at solving the aforementioned problems, that a steel sheet having a specific chemical composition, and having a steel microstructure mainly composed of ferrite and martensite, may be obtainable as a high strength steel sheet that excels in material uniformity, by controlling variation in area fraction of non-recrystallized ferrite in the longitudinal direction of the steel sheet. Summary of aspects of the present invention is as follows.

[1] A high strength steel sheet having a chemical composition in mass % containing:
C: 0.06% or more and 0.14% or less,
Si: 0.1% or more and 1.5% or less,
Mn: 1.4% or more and 2.2% or less,
P: 0.05% or less,
S: 0.0050% or less,
Al: 0.01% or more and 0.20% or less,
N: 0.10% or less,
Nb: 0.015% or more and 0.060% or less, and
Ti: 0.001% or more and 0.030% or less,
contents of S, N and Ti satisfying Formula (1) below,
a balance being Fe and an inevitable impurity,
including, in terms of area fraction relative to an entire steel microstructure, 30% or more and 100% or less ferrite, 0% or more and 70% or less martensite, and less than 20% in total of pearlite, bainite and retained austenite, and the ferrite containing, in terms of area fraction relative to an entire microstructure, 0% or more and 10% or less non-recrystallized ferrite, with a difference between a maximum value and a minimum value of the area fraction of the non-recrystallized ferrite in a longitudinal direction of the steel sheet of 5% or below:

$$[\%\ Ti]-(48/14)[\%\ N]-(48/32)[\%\ S]\leq 0, \quad \text{Formula (1):}$$

in Formula (1), [% Ti] represents content (mass %) of component element Ti, [% N] represents content (mass %) of component element N, and [% S] represents content (mass %) of component element S.

[2] The high strength steel sheet according to [1], wherein the chemical composition further contains, in mass %, one of, or two or more of Cr: 0.01% or more and 0.15% or less, Mo: 0.01% or more and less than 0.10%, and V: 0.001% or more and 0.065% or less.

[3] The high strength steel sheet according to [1] or [2], wherein the chemical composition further contains, in mass %, B: 0.0001% or more and less than 0.002%.

[4] The high strength steel sheet according to any one of [1] to [3], wherein the chemical composition further contains, in mass %, one of or two of Cu: 0.001% or more and 0.2% or less, and Ni: 0.001% or more and 0.1% or less.

[5] The high strength steel sheet according to any one of [1] to [4], having a plating layer on a surface of the steel sheet.

[6] A high strength member including the high strength steel sheet according to any one of [1] to [5] subjected to at least either forming or welding.

[7] A method for manufacturing a high strength steel sheet, including: a hot rolling process in which a steel slab having the chemical composition according to any one of [1] to [4] is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to 650° C. or lower at an average cooling rate of 10° C./sec or faster, and then coiled at 650° C. or lower; and an annealing process in which the hot rolled steel sheet obtained in the hot rolling process is heated up to an annealing temperature which is $A_{C1}$ transformation temperature or higher and ($A_{C3}$ transformation temperature+20° C.) or lower, at an average heating rate from 600° C. to 700° C. of 8° C./sec or slower, held at the annealing temperature for a hold time t (second) that satisfies Formula (3) below, and then cooled:

$$0.80\times(2.4-6700/T)\leq\log\{[\%\ Nb]\times([\%\ C]+12/14[\%\ N])\}\leq 0.65\times(2.4-6700/T) \quad \text{Formula (2):}$$

In Formula (2), T represents heating temperature (° C.) of the steel slab, [% Nb] represents content (mass %) of component element Nb, [% C] represents content (mass %) of component element C, and [% N] represents content (mass %) of component element N.

$$1500\leq(AT+273)\times\log t<5000 \quad \text{Formula (3):}$$

In Formula (3), AT represents annealing temperature (° C.), and t represents hold time (second) at the annealing temperature.

[8] A method for manufacturing a high strength steel sheet, including: a hot rolling process in which a steel slab having the chemical composition according to any one of [1] to [4] is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to 650° C. or lower at an average cooling rate of 10° C./sec or faster, and then coiled at 650° C. or lower;

a cold rolling process in which the hot rolled steel sheet obtained in the hot rolling process is cold-rolled; and an annealing process in which the cold rolled steel sheet obtained in the cold rolling process is heated up to an annealing temperature which is $A_{C1}$ transformation temperature or higher and ($A_{C3}$ transformation temperature+20° C.) or lower, at an average heating rate from 600° C. to 700° C. of 8° C./sec or slower, held at the annealing temperature for a hold time t (second) that satisfies Formula (3) below, and then cooled:

$$0.80\times(2.4-6700/T)\leq\log\{[\%\ Nb]\times([\%\ C]+12/14[\%\ N])\}\leq 0.65\times(2.4-6700/T) \quad \text{Formula (2):}$$

In Formula (2), T represents heating temperature (° C.) of the steel slab, [% Nb] represents content (mass %) of component element Nb, [% C] represents content (mass %) of component element C, and [% N] represents content (mass %) of component element N.

$$1500\leq(AT+273)\times\log t<5000 \quad \text{Formula (3):}$$

In Formula (3), AT represents annealing temperature (° C.), and t represents hold time (second) at the annealing temperature.

[9] The method for manufacturing a high strength steel sheet according to [7] or [8], further including a plating process for providing plating, following the annealing process.

[10] A method for manufacturing a high strength member, including subjecting the high strength steel sheet manufactured by the method for manufacturing a high strength steel sheet according to any one of [7] to [9], to at least either forming or welding.

Aspects of the present invention control the steel microstructure and controls variation in area fraction of non-recrystallized ferrite in the longitudinal direction of the steel sheet, by adjusting the chemical composition and the manufacturing method. The high strength steel sheet according to aspects of the present invention excels in material uniformity, as a consequence.

The high strength steel sheet according to aspects of the present invention, when applied for example to automotive structural member, can make automobile steel sheet having both high strength and material uniformity. That is, aspects of the present invention can keep the parts in good shape, and can enhance performance of the automotive body.

BRIEF DESCRIPTION OF THE DRAWINGS

The FIGURE is a cross-sectional view of a steel sheet according to aspects of the present invention taken in the thickness direction, observed under a scanning electron microscope.

DETAILED DESCRIPTION OF EMBODIMENTS OF THE INVENTION

Hereafter, the embodiments of the present invention will be described. Here, the present invention is not limited to the embodiments described below.

First, a chemical composition of the high strength steel sheet (may occasionally be referred to as "steel sheet according to aspects of the present invention", hereinafter) will be explained. In the description below regarding the chemical composition of the steel sheet, "%" used as a unit of content of each component "mass %". Note that high strength in the context of aspects of the present invention means a tensile strength of 590 MPa or larger.

Also note that the steel sheet according to aspects of the present invention basically targeted at a steel sheet obtained by at least heating a steel slab in a heating furnace, hot-rolling each slab, and then coiling it. The steel sheet according to aspects of the present invention has high material uniformity in the longitudinal direction (rolling direction) of the steel sheet. That is, the steel sheet excels in material uniformity, with respect to each steel sheet (coil).

C: 0.06% or More and 0.14% or Less

C is necessary from the viewpoint of achieving TS 590 MPa, by enhancing strength of martensite or by precipitation hardening with use of fine precipitate. C content less than 0.06% will fail in achieving a predetermined strength. Thus, the C content is set to 0.06% or more. The C content is preferably 0.07% or more. On the other hand, the C content more than 0.14% will increase area fraction of martensite, leading to excessive strength. Such content will also increase the amount of production of carbide, and this makes recrystallization less likely to occur, thus degrading the material uniformity. Thus, the C content is set to 0.14% or less. The C content is preferably 0.13% or less.

Si: 0.1% or More and 1.5% or Less

Si is a strengthening element that causes solid solution strengthening. To obtain this effect, Si content is set to 0.1% or more. The Si content is preferably 0.2% or more, and more preferably 0.3% or more. Meanwhile, Si demonstrates a suppressive effect on production of cementite, so that excessive Si content will suppress cementite from being produced, and unprecipitated C forms carbide with Nb or Ti and becomes coarsened, whereby the material uniformity degrades. Thus, the Si content is set to 1.5% or less. The Si content is preferably 1.4% or less.

Mn: 1.4% or More and 2.2% or Less

Mn is included in order to improve hardenability of steel, and to achieve a predetermined area fraction of martensite. Mn content less than 1.4% will decrease the amount of fine precipitate since pearlite or bainite is produced during cooling, and this makes it difficult to achieve necessary strength. Thus, the Mn content is set to 1.4% or more. The Mn content is preferably 1.5% or more. On the other hand, excessive Mn content will increase the area fraction of martensite, leading to excessive strength. Moreover, formation of MnS results in the total amount of N and S being less than amount of Ti, and this increases variation in precipitate in the longitudinal direction of the steel sheet, and increases variation in the area fraction of non-recrystallized ferrite, thereby degrading the material uniformity. Thus, the Mn content is set to 2.2% or less. The Mn content is preferably 2.1% or less.

P: 0.05% or Less

P is an element that can strengthen the steel, but the excessive content thereof will result in segregation at grain boundary, thus degrading the workability. P content is therefore controlled to 0.05% or less, in order to achieve a minimum necessary level of workability when applied to automobile. The P content is preferably 0.03% or less, and more preferably 0.01% or less. Although the lower limit of the P content is not specifically limited, an industrially feasible lower limit at present is approximately 0.003%.

S: 0.0050% or Less

S degrades the workability, through formation of MnS, TiS, Ti(C, S) and so forth. S also suppresses recrystallization to degrade the material uniformity. Hence, the S content needs to be controlled to 0.0050% or less. The S content is preferably 0.0020% or less, more preferably 0.0010% or less, and still more preferably 0.0005% or less. Although the lower limit of the S content is not specifically limited, an industrially feasible lower limit at present is approximately 0.0002%.

Al: 0.01% or More and 0.20% or Less

Al is added in order to cause thorough deoxidation and to reduce the coarse inclusion in the steel. The effect emerges at an Al content of 0.01% or more. The Al content is preferably 0.02% or more. On the other hand, with the Al content more than 0.20%, the carbide produced during coiling after hot rolling will become less likely to solute in an annealing process, will suppress recrystallization, thus degrading the material uniformity. Thus, the Al content is set to 0.20% or less. The Al content is preferably 0.17% or less, and more preferably 0.15% or less.

N: 0.10% or Less

N is an element that forms, in the steel, nitride-based or carbonitride-based coarse inclusion such as TiN, (Nb, Ti) (C, N), or AlN. With the N content more than 0.10%, variation in the precipitate in the longitudinal direction of the steel sheet cannot be suppressed, thus increasing variation in the area fraction of non-recrystallized ferrite in the longitudinal direction of the steel sheet, and degrading the material uniformity.

Hence, the N content needs to be controlled to 0.10% or less. The N content is preferably 0.07% or less, and more preferably 0.05% or less. Although the lower limit of the N content is not specifically limited, an industrially feasible lower limit at present is approximately 0.0006%.

Nb: 0.015% or More and 0.060% or Less

Nb contributes to precipitation hardening through production of fine precipitate. In order to obtain such effect, Nb content is necessarily 0.015% or more. The Nb content is preferably 0.020% or more, and more preferably 0.025% or more. On the other hand, large content of Nb increases variation in the area fraction of non-recrystallized ferrite in the longitudinal direction of the steel sheet, and thus degrades the material uniformity. Thus, the Nb content is set to 0.060% or less. The Nb content is preferably 0.055% or less, and more preferably 0.050% or less.

Ti: 0.001% or More and 0.030% or Less

Ti contributes to precipitation hardening through production of fine precipitate. In order to obtain such effect, Ti content is necessarily 0.001% or more. The Ti content is preferably 0.002% or more, and more preferably 0.003% or more. On the other hand, large content of Ti increases variation in the area fraction of non-recrystallized ferrite in the longitudinal direction of the steel sheet, and thus degrades the material uniformity. Thus, the Ti content is set to 0.030% or less. The Ti content is preferably 0.020% or less, more preferably 0.017% or less, and still more preferably 0.015% or less.

The contents of S, N and Ti satisfy Formula (1) below:

$$[\%\ Ti]-(48/14)[\%\ N]-(48/32)[\%\ S]\leq 0, \qquad \text{Formula (1):}$$

in Formula (1), [% Ti] represents content (mass %) of component element Ti, [% N] represents content (mass %) of component element N, and [% S] represents content (mass %) of component element S.

With the amount of Ti controlled to be not larger than the total amount of N and S in atomic ratio, Ti-containing carbide that is possibly produced during coiling may be suppressed from being produced, thus making it possible to suppress variation in the amount of fine precipitate in the longitudinal direction of the steel sheet. Since the fine precipitate affects recrystallization behavior during the annealing process, suppression of variation in the amount of fine precipitate in the longitudinal direction of the steel sheet can reduce variation in the area fraction of non-recrystallized ferrite in the longitudinal direction of the steel sheet, thus excellent material uniformity is obtainable. In order to obtain such effect, "[% Ti]−(48/14)[% N]−(48/32)[% S]" is 0 (0.0000) or smaller, which is preferably smaller than 0 (0.0000), and more preferably −0.001 or smaller. The lower limit of "[% Ti]−(48/14)[% N]−(48/32)[% S]", although not specifically limited, is preferably −0.01 or larger, in order to suppress production of inclusion that is possibly ascribed to excessive N content and S content.

The steel sheet according to aspects of the present invention contains the aforementioned components, and the balance other than the aforementioned components has a chemical composition that contains Fe (iron) and an inevitable impurity. Now, the steel sheet according to aspects of the present invention preferably contains the aforementioned components, and the balance preferably has a chemical composition that is composed of Fe and an inevitable impurity. The steel sheet according to aspects of the present invention can also contain the components below, as freely selectable components. Note that any of the freely selectable components below, if the content thereof is less than the lower limit value, is understood to be contained as the inevitable impurity.

Any One of, or Two or More of Cr: 0.01% or More and 0.15% or Less; Mo: 0.01% or More and Less than 0.10%; and V: 0.001% or More and 0.065% or Less Cr, Mo, and V may be contained, for the purpose of improving hardenability of steel. In order to obtain such effect, both of Cr content and Mo content are preferably 0.01% or more, and more preferably 0.02% or more. The V content is preferably 0.001% or more, and more preferably 0.002% or more. Note however that any of these elements, when contained excessively, can degrade the material uniformity by producing carbides. Therefore, the Cr content is preferably 0.15% or less, and more preferably 0.12% or less. The Mo content is preferably less than 0.10%, and more preferably 0.08% or less. The V content is preferably 0.065% or less, and more preferably 0.05% or less.

B: 0.0001% or More and Less than 0.002%

B is an element that improves the hardenability of the steel, and when contained, demonstrates an effect of producing martensite with a predetermined area fraction, even if the Mn content is low. To obtain such an effect of B, the B content is preferably 0.0001% or more. The B content is more preferably 0.00015% or more. On the other hand, B whose content is more than 0.002% will form nitride with N, and Ti whose amount becomes abundant will easily form carbide during coiling, thus degrading the material uniformity. Thus, the B content is preferably less than 0.002%. The B content is more preferably less than 0.001%, and more preferably 0.0008% or less.

One of, or Two of Cu: 0.001% or More and 0.2% or Less, and Ni: 0.001% or More and 0.1% or Less Cu and Ni demonstrate effects of improving corrosion resistance in use environment of automobiles, and of suppressing hydrogen penetration into the steel sheet, through coverage of the surface of the steel sheet with corrosion products. In order to attain a minimum necessary level of corrosion resistance for automotive use, both of the Cu and Ni contents are preferably 0.001% or more, and more preferably 0.002% or more. In order to suppress surface defect from occurring due to excessive Cu and Ni contents, the Cu content is however preferably 0.2% or less, and more preferably 0.15% or less. The Ni content is preferably 0.1% or less, and more preferably 0.07% or less.

Note that the steel sheet according to aspects of the present invention may contain Ta, W, Sn, Sb, Ca, Mg, Zr or REM as the other element, without damaging the effect according to aspects of the present invention, where a content of each of these elements of 0.1% or less is acceptable.

Next, the steel microstructure of the steel sheet according to aspects of the present invention will be explained. The steel sheet according to aspects of the present invention contains, in terms of area fraction relative to an entire steel microstructure, 30% or more and 100% or less ferrite, 0% or more and 70% or less martensite, and less than 20% in total of pearlite, bainite and retained austenite, and the ferrite contains, in terms of area fraction relative to an entire microstructure, 0% or more and 10% or less non-recrystallized ferrite, with a difference between the maximum area fraction and minimum are fraction of the non-recrystallized ferrite in the longitudinal direction of the steel sheet of 5% or smaller.

Area Fraction of Ferrite is 30% or More and 100% or Less

C hardly forms solid solution with ferrite, and migrates so as to be expelled from ferrite, but when cooled, C forms carbide before being expelled. The area fraction of ferrite is important in terms of precipitate producing site, and when controlled to 30% or more, allows the precipitate to be fully produced, whereby the strength is improved by a synergistic effect of structural hardening due to martensite and precipitation hardening due to the precipitate. Hence, the area fraction of ferrite is specified to 30% or larger. The area fraction of ferrite is preferably 35% or larger, more preferably 40% or larger, and even more preferably 50% or larger. The upper limit of the area fraction of ferrite is not specifically limited, and may even be 100% so far as a sufficient level of strength may be achieved by precipitation hardening with the aid of fine precipitate. Since, however, large area fraction of ferrite tends to increase variation in the amount of fine precipitate in the longitudinal direction of the steel sheet, the area fraction of ferrite is preferably 95% or smaller, and more preferably 90% or smaller.

Area Fraction of Martensite is 0% or More and 70% or Less

With the area fraction of martensite more than 70% relative to the entire microstructure, the strength will become excessive. This also increases the amount of production of precipitate in ferrite to suppress recrystallization, thus increasing variation in the area fraction of non-recrystallized ferrite in the longitudinal direction of the steel sheet, and degrading the material uniformity. The area fraction of martensite, relative to the entire steel microstructure is therefore specified to be 70% or smaller. The area fraction of martensite is preferably 65% or smaller, and more preferably 60% or smaller. The lower limit of the area fraction of martensite is not specifically limited, and may even be 0% so far as a sufficient level of strength may be achieved by precipitation hardening with the aid of fine precipitate. The area fraction of martensite is preferably 5% or larger and more preferably 10% or larger, from the viewpoint of suppressing variation in the area fraction of non-recrystallized ferrite, through suppression of variation in the amount of fine precipitate in the longitudinal direction of the steel sheet as previously suggested.

The balance other than ferrite and martensite includes retained austenite, bainite and pearlite, and is acceptable if the area fraction thereof accounts for less than 20%. The area fraction of the balance is preferably 10% or less, and more preferably 7% or less. The area fraction of the balance may even be 0%. In accordance with aspects of the present invention, ferrite is a microstructure that is produced as a result of transformation from austenite at relatively high temperatures, and is composed of crystal grains having BCC lattice. Martensite refers to a hard microstructure that is produced from austenite at low temperatures (at or below martensite transformation temperature). Bainite refers to a hard microstructure that is produced from austenite at relatively low temperatures (at or above martensite transformation temperature), in which fine carbide is dispersed in needle-like or plate-like ferrite. Pearlite refers to a microstructure that is produced from austenite, and is composed of lamellar ferrite and cementite. Retained austenite is produced as a result of lowering of the martensite transformation temperature in austenite down to room temperature or below by concentration of C or other element in the austenite.

Ferrite Contains 0% or More and 10% or Less Non-Recrystallized Ferrite, in Terms of Area Fraction Relative to Entire Microstructure The non-recrystallized ferrite in the context according to aspects of the present invention refers to a ferrite particle that contains sub-boundary in the crystal grain. The sub-boundary may be observed by a method described later in Examples. The FIGURE is a cross-sectional view of a steel sheet according to aspects of the present invention taken in the thickness direction, practically observed under a scanning electron microscope. In the FIGURE, an exemplary site where the non-recrystallized ferrite resides is circled with a broken line, where the non-recrystallized ferrite contains sub-boundary in the crystal grain.

The non-recrystallized ferrite, which recrystallizes during annealing to become ferrite, can cause variation in the rate of recrystallization in the longitudinal direction of the steel sheet, and degradation of material uniformity, if the area fraction thereof relative to the entire microstructure is more than 10%. With the area fraction of non-recrystallized ferrite relative to the entire microstructure controlled to 10% or smaller, variation in recrystallization may be suppressed, and thus variation in yield ratio may be reduced. Hence, out of the area fraction of ferrite, the area fraction of non-recrystallized ferrite relative to the entire microstructure is 10% or smaller, preferably 9% or smaller, and more preferably 8% or smaller. The smaller the amount of non-recrystallized ferrite the better, which may even be 0%.

Values of the area fraction of the individual structures in the steel microstructure employed herein are those obtained by measurement according to methods described later in Examples.

Difference Between Maximum Value and Minimum Value of Area Fraction of Non-Recrystallized Ferrite in Longitudinal Direction of Steel Sheet is 5% or Smaller Since the area fraction of non-recrystallized ferrite directly affects the strength, suppression of variation in the amount of fine precipitate in the longitudinal direction of the steel sheet can reduce variation in the area fraction of non-recrystallized ferrite, thus excellent material uniformity is obtainable. In order to obtain such effect, difference between the maximum value and the minimum value of the area fraction of non-recrystallized ferrite in the longitudinal direction of the steel sheet is specified to 5% or smaller. The difference is preferably 4% or smaller, and more preferably 3% or smaller. The lower limit of the difference is not specifically limited, and may even be 0%. The "difference between the maximum value and the minimum value of the area fraction of non-recrystallized ferrite in the longitudinal direction of the steel sheet specified to 5% or smaller" in the context according to aspects of the present invention means that the difference between the maximum value and the minimum value of the area fraction of non-recrystallized ferrite is 5% or smaller, over the entire length of the longitudinal direction (rolling direction) of the steel sheet, with respect to each steel sheet (coil). The difference may be measured by a method described later in Examples.

The steel sheet according to aspects of the present invention may have a plating layer on the surface of the steel sheet. The plating layer is typically an electrogalvanized layer, hot-dip galvanized layer, or hot-dip galvannealed layer, without limitation in particular.

Next, properties of the high strength steel sheet according to aspects of the present invention will be explained.

The steel sheet according to aspects of the present invention has a tensile strength of 590 MPa or larger, when measured by a method described later in Examples. The tensile strength, although not specifically limited, is preferably smaller than 980 MPa, from the viewpoint of easy balancing with other properties.

The steel sheet according to aspects of the present invention excels in the material uniformity. More specifically, difference between the maximum value and the minimum value of the yield ratio (ΔYR) in the longitudinal direction of the steel sheet, calculated from tensile strength and yield strength measured by a method described later in Examples, is 0.05 or smaller. The difference is preferably 0.03 or less, and more preferably 0.02 or less.

Next, a method for manufacturing the high strength steel sheet according to aspects of the present invention will be explained.

The method for manufacturing the high strength steel sheet according to aspects of the present invention has a hot rolling process, an optional cold rolling process, and an annealing process. Now, the temperature when heating or cooling the slab (steel raw material), steel sheet or the like described below, is understood to be surface temperature of the slab (the steel raw material), steel sheet or the like, unless otherwise specifically noted.

<Hot Rolling Process>

A hot rolling process is a process in which a steel slab having the chemical composition described above is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to 650° C. or lower at an average cooling rate of 10° C./sec or faster, and then coiled at 650° C. or lower.

$$0.80\times(2.4-6700/T)\leq\log\{[\%\ Nb]\times([\%\ C]+12/14[\%\ N])\}\leq 0.65\times(2.4-6700/T) \quad \text{Formula (2):}$$

In Formula (2), T represents heating temperature (° C.) of the steel slab, [% Nb] represents content (mass %) of component element Nb, [% C] represents content (mass %) of component element C, and [% N] represents content (mass %) of component element N.

If the slab heating temperature is low, Nb-containing carbonitride is excessively produced during slab heating, and this makes amount of Ti larger than the total of amount of N and amount of S during coiling, and degrades the material uniformity. Meanwhile, if the slab heating temperature is high, a large amount of precipitate is produced during coiling, so that variation in the area fraction of non-recrystallized ferrite in the longitudinal direction of the steel sheet cannot be controlled, thus the material uniformity degrades. Hence, the slab heating temperature is determined to satisfy the aforementioned Formula (2). Heating temperature T (° C.) of steel slab preferably satisfies Formula (2A) below, and more preferably satisfies Formula (2B) below.

$$0.79\times(2.4-6700/T)\leq \mathrm{Log}\ \{[\%\ Nb]\times([\%\ C]+12/14[\%\ N])\}\leq 0.67\times(2.4-6700/T) \quad \text{Formula (2A):}$$

$$0.78\times(2.4-6700/T)\leq \mathrm{Log}\ \{[\%\ Nb]\times([\%\ C]+12/14[\%\ N])\}\leq 0.70\times(2.4-6700/T) \quad \text{Formula (2B):}$$

Soaking time is specified to 1.0 hour or longer. A soaking time of shorter than 1.0 hour is insufficient for Nb- and Ti-containing carbonitrides to fully solute, so that the Nb-containing carbonitride will excessively remain during slab heating. Hence, the amount of Ti will become larger than total of the amount of N and the amount of S during coiling, thereby degrading the material uniformity. The soaking time is therefore specified to 1.0 hour or longer, and preferably 1.5 hours or longer. The upper limit of the soaking time, although not specifically limited, is usually 3 hours or shorter. Heating rate when heating a cast steel slab to the slab heating temperature, although not specifically limited, is preferably controlled to 5 to 15° C./min.

Average Cooling Rate from Slab Heating Temperature Down to Rolling Start Temperature is 2° C./Sec or Faster If the average cooling rate from the slab heating temperature down to the rolling start temperature is slower than 2° C./sec, the Nb-containing carbonitride is excessively produced, so that the amount of Ti will become larger than total amount of N and S during coiling, thereby degrading the material uniformity. The average cooling rate from the slab heating temperature down to the rolling start temperature is therefore specified to 2° C./sec or faster. The average cooling rate is preferably 2.5° C./sec or faster, and more preferably 3° C./sec or faster. The upper limit of the average cooling rate, although not specifically limited from the viewpoint of improving the material uniformity, is preferably specified to be 1000° C./sec or slower, from the viewpoint of energy saving of cooling facility.

Finisher Delivery Temperature is 850° C. or Higher

If the finisher delivery temperature is lower than 850° C., longer time requires for decrease in temperature, during which Nb- or Ti-containing carbonitride can be produced. This consequently reduces the amount of N, fails in suppressing production of Ti-containing precipitate that is possibly produced during coiling, increases variation in the area fraction of non-recrystallized ferrite in the longitudinal direction of the steel sheet, and degrades the material uniformity. The finisher delivery temperature is therefore specified to 850° C. or higher. The finisher delivery temperature is preferably 860° C. or higher. Meanwhile, the upper limit of the finisher delivery temperature, although not specifically limited, is preferably 950° C. or lower and more preferably 920° C. or lower, in order to avoid difficulty of cooling down to the coiling temperature.

Coiling Temperature is 650° C. or Lower

If the coiling temperature is higher than 650° C., a large amount of precipitate is produced as a result of coiling, so that variation in the area fraction of non-recrystallized ferrite in the longitudinal direction of the steel sheet cannot be suppressed, thereby degrading the material uniformity. Thus, the coiling temperature is 650° C. or lower, and preferably 640° C. or lower. The lower limit of the coiling temperature, although not specifically limited, is preferably 400° C. or higher, and more preferably 420° C. or higher, in order to obtain the precipitate that contributes to precipitation hardening.

Average Cooling Rate from Finisher Delivery Temperature Down to Coiling Temperature is 10° C./sec or Faster If the average cooling rate from the finisher delivery temperature down to the coiling temperature is slow, the Nb- or Ti-containing carbonitride is excessively produced before coiling, this consequently decreases the amount of N, fails in suppressing production of Ti-containing precipitate that is produced as a result of coiling, increases variation in the area fraction of non-recrystallized ferrite in the longitudinal direction of the steel sheet, and degrades the material uniformity. The average cooling rate from the finisher delivery temperature down to the coiling temperature is therefore specified to 10° C./sec or faster. The average cooling rate is preferably 20° C./sec or faster, and more preferably 30° C./sec or faster. The upper limit of the average cooling rate, although not specifically limited from the viewpoint of improving the material uniformity, is preferably specified to be 1000° C./sec or slower, from the viewpoint of energy saving of cooling facility.

The coiled hot rolled steel sheet may be pickled. Pickling conditions are not specifically limited.

<Cold Rolling Process>

The cold rolling process is a process for cold-rolling the hot rolled steel sheet obtained in the hot rolling process. Reduction ratio of the cold rolling, although not specifically limited, is preferably specified to 20% or larger, from the viewpoint of improving flatness of the surface, and making the microstructure further uniform. The upper limit of the reduction ratio, although not specifically limited, is preferably 95% or smaller, in consideration of cold rolling load. Note that the cold rolling process is not essential, and is omissible if the steel microstructure and mechanical properties satisfy aspects of the present invention.

<Annealing Process>

An annealing process is a process in which the cold rolled steel sheet or the hot rolled steel sheet is heated up to an annealing temperature which is $A_{C1}$ transformation temperature or higher and ($A_{C3}$ transformation temperature+20° C.) or lower, at an average heating rate from 600° C. to 700° C. of 8° C./sec or slower, held at the annealing temperature for a hold time t (second) that satisfies Formula (3) below, and then cooled.

$$1500\leq(AT+273)\times\log t<5000 \quad \text{Formula (3):}$$

In Formula (3), AT represents annealing temperature (° C.), and t represents hold time (second) at the annealing temperature.

Average Heating Rate from 600° C. to 700° C. is 8° C./Sec or Slower

Recrystallization temperature falls in the temperature range from 600° C. to 700° C., so that the average heating rate within this temperature range is necessarily slow in order to promote recrystallization. If the average heating rate from 600° C. to 700° C. is faster than 8° C./sec, the amount of non-recrystallized ferrite increases, so that the recrystallization ratio in the longitudinal direction of the steel sheet will vary, thus the material uniformity degrades. The average heating rate from 600° C. to 700° C. is therefore specified to 8° C./sec or slower. The average heating rate is preferably 7° C./sec or slower, and more preferably 6° C./sec or slower. The lower limit of the average heating rate, although not specifically limited, is usually 0.5° C./sec or faster.

Annealing Temperature is $A_{C1}$ Transformation Temperature or Higher and ($A_{C3}$ Transformation Temperature+20° C.) or Lower If the annealing temperature is lower than $A_{C1}$ transformation temperature, fine precipitate that can be produced during annealing becomes less likely to be produced due to cementite production, making it difficult to obtain a necessary amount of fine precipitate for proper strength to be achieved. This also suppresses recrystallization, so that variation in the area fraction of non-recrystallized ferrite in the longitudinal direction of the steel sheet cannot be controlled, and thus the material uniformity degrades. The annealing temperature is therefore specified to be $A_{C1}$ transformation temperature or higher. The annealing temperature is preferably ($A_{C1}$ transformation temperature+10° C.) or higher, and more preferably ($A_{C1}$ transformation temperature+20° C.) or higher. On the other hand, if the annealing temperature is higher than ($A_{C3}$ transformation temperature+20° C.), the area fraction of martensite becomes larger than 70%, leading to excessive strength. This also increases the amount of production of precipitate in ferrite to suppress recrystallization, thus increasing variation in the area fraction of non-recrystallized ferrite in the longitudinal direction of the steel sheet, and degrading the material uniformity. The annealing temperature is therefore specified to be ($A_{C3}$ transformation temperature+20° C.) or lower. The annealing temperature is preferably ($A_{C3}$ transformation temperature+10° C.) or lower, and more preferably $A_{C3}$ transformation temperature or lower.

Note that the $A_{C1}$ transformation temperature and $A_{C3}$ transformation temperature are calculated using Formulae below. Also note that (% element symbol) represents the content (mass %) of each element in the following formulae.

$$A_{C1}(^\circ\text{ C.})=723+22[\%\text{ Si}]-18[\%\text{ Mn}]+17[\%\text{ Cr}]+4.5[\%\text{ Mo}]+16[\%\text{ V}]$$

$$A_{C3}(^\circ\text{ C.})=910-203\sqrt{[\%\text{ C}]}+45[\%\text{ Si}]-30[\%\text{ Mn}]-20[\%\text{ Cu}]-15[\%\text{ Ni}]+11[\%\text{ Cr}]+32[\%\text{ Mo}]+104[\%\text{ V}]+400[\%\text{ Ti}]+460[\%\text{ Al}]$$

Hold time t (second) at annealing temperature AT (° C.) satisfies Formula (3).

A short hold time at the annealing temperature makes reverse transformation to austenite less likely to occur, so that the fine precipitate that can be produced during annealing becomes less likely to be produced due to production of cementite, making it difficult to obtain a necessary amount of fine precipitate for proper strength to be achieved. On the other hand, a long hold time at the annealing temperature increases the amount of production of precipitate in ferrite, so that the recrystallization is suppressed, variation in the area fraction of non-recrystallized ferrite in the longitudinal direction of the steel sheet increases, and the material uniformity degrades. The hold time t (second) at the annealing temperature AT (° C.) therefore satisfies Formula (3). The hold time t (second) at the annealing temperature AT (° C.) preferably satisfies Formula (3A) below, and more preferably satisfies Formula (3B) below.

$$1600\leq(AT+273)\times\log t<4900 \quad \text{Formula (3A):}$$

$$1700\leq(AT+273)\times\log t<4800 \quad \text{Formula (3B):}$$

Cooling rate during cooling after holding at the annealing temperature is not specifically limited.

Note that the hot rolled steel sheet after the hot rolling process may be subjected to heat treatment for softening the microstructure. Also note that the annealing process may be followed by temper rolling for shape control.

The annealing process may be followed by plating process for plating, so long as properties of the steel sheet will not change. The plating is, for example, a process of subjecting the surface of the steel sheet to electrogalvanized plating, hot-dip galvanizing, or hot-dip galvannealing. When subjecting the surface of the steel sheet to hot-dip galvanizing, a hot-dip galvanized layer is preferably formed on the surface of the steel sheet, typically by dipping the steel sheet obtained as described previously into a galvanizing bath at 440° C. or higher and 500° C. or lower. The plating is preferably followed by control of the coating weight, typically by gas wiping. The steel sheet after hot-dip galvanizing may be subjected to alloying. The hot-dip galvanized layer, when alloyed, is preferably alloyed in the temperature range from 450° C. or higher and 580° C. or lower, by holding it for 1 second or longer and 60 seconds or shorter. When subjecting the surface of the steel sheet to electrogalvanization, process conditions may conform to those of any of conventional methods without limitation in particular.

According to the aforementioned manufacturing method of this embodiment, it now becomes possible, through control of hot-rolling conditions and temperature and time of annealing, to suppress variations in the microstructure proportion and in the area fraction of non-recrystallized ferrite in the longitudinal direction of the steel sheet, and to obtain the high strength steel sheet that excels in material uniformity.

Next, the high strength member and the method for manufacturing the same according to aspects of the present invention will be explained.

The high strength member according to aspects of the present invention is the high strength steel sheet according to aspects of the present invention subjected to at least either forming or welding. Moreover, the method for manufacturing the high strength member includes subjecting the high strength steel sheet manufactured by the method for manufacturing a high strength steel sheet according to aspects of this invention, to at least either forming or welding.

Since the high strength steel sheet according to aspects of the present invention is well balanced between high strength and material uniformity, the high strength member obtained with use of the high strength steel sheet according to aspects of the present invention can keep good shape of parts. Hence, the high strength member according to aspects of the present invention is suitably applicable, for example, to automotive structural member.

The forming may rely upon any of common forming methods such as press working, without limitation. The welding may rely upon any of common welding such as spot welding or arc welding, without limitation.

EXAMPLES

Example 1

The present invention will now be specifically described with reference to Examples. Note that the scope of the present invention is not limited to the following Examples.

1. Manufacture of Steel Sheet for Evaluation

Each steel having a chemical composition listed in Table 1, and the balance that includes Fe and inevitable impurity was melted in a vacuum melting furnace, and bloomed to obtain a bloomed material of 27 mm thick. The bloomed material thus obtained was then hot-rolled to a thickness of 4.0 mm. Conditions of the hot rolling process are as summarized in Table 2. Next, a sample of each hot rolled steel sheet, intended to be further cold-rolled, was ground to reduce the thickness to 3.2 mm, and cold-rolled according to a reduction ratio listed in Table 2, to manufacture each cold rolled steel sheet. Next, each of the hot rolled steel sheet and the cold rolled steel sheet was annealed under conditions listed in Table 2, to manufacture each steel sheet. Sample No. 55 in Table 2 is a steel sheet whose surface was subjected, after annealing, to hot-dip galvanizing. Sample No. 56 in Table 2 is a steel sheet whose surface, after annealing, was subjected to hot-dip galvannealing. Sample No. 57 in Table 2 is a steel sheet whose surface, after annealing and subsequent cooling down to room temperature, was subjected to electrogalvanizing.

Note that the blank cells in Table 1 represent that elements were not intentionally added but were not always 0 mass %, occasionally allowing inevitable content.

Meanwhile, "-" in the cells of cold rolling in Table 2 represents that the steel sheet was not cold-rolled.

Again in Table 2, "1: lower limit of slab heating temperature calculated from Formula (2)" represents values calculated by using Formula (2-1), a part of Formula (2). Again in Table 2, "2: upper limit of slab heating temperature calculated from Formula (2)" represents values calculated by using Formula (2-2), a part of Formula (2).

$$0.80\times(2.4-6700/T)\leq\log\{[\%\ Nb]\times([\%\ C]+12/14[\%\ N])\}\leq 0.65\times(2.4-6700/T) \quad \text{Formula (2):}$$

$$\log\{[\%\ Nb]\times([\%\ C]+12/14[\%\ N])\}\leq 0.65\times(2.4-6700/T) \quad \text{Formula (2-1):}$$

$$0.80\times(2.4-6700/T)\leq\log\{[\%\ Nb]\times([\%\ C]+12/14[\%\ N])\} \quad \text{Formula (2-2):}$$

In Formula (2), Formula (2-1), and Formula (2-2), T represents heating temperature (° C.) of the steel slab, [% Nb] represents content of component element Nb (mass %), [% C] represents content of component element C (mass %), and [% N] represents component element N (mass %).

TABLE 1

| Steel | Chemical composition (in mass %) | | | | | | | | | | | | | | | | $A_{c1}$ | $A_{c3}$ |
|---|---|---|---|---|---|---|---|---|---|---|---|---|---|---|---|---|---|---|
| type | C | Si | Mn | P | S | Al | N | Nb | Ti | Cr | Mo | V | B | Cu | Ni | *1 | (° C.) | (° C.) |
| A | 0.090 | 0.50 | 1.80 | 0.007 | 0.0008 | 0.05 | 0.0031 | 0.045 | 0.008 | | | | | | | −0.0038 | 702 | 842 |
| B | 0.062 | 0.48 | 1.84 | 0.007 | 0.0009 | 0.02 | 0.0022 | 0.045 | 0.005 | | | | | | | −0.0039 | 701 | 836 |
| C | 0.132 | 0.15 | 1.74 | 0.007 | 0.0008 | 0.05 | 0.0033 | 0.018 | 0.012 | | | | | | | −0.0005 | 695 | 815 |
| D | 0.088 | 1.47 | 2.00 | 0.007 | 0.0008 | 0.05 | 0.0021 | 0.045 | 0.008 | | | | | | | −0.0004 | 720 | 880 |
| E | 0.093 | 0.30 | 1.42 | 0.009 | 0.0007 | 0.04 | 0.0026 | 0.045 | 0.002 | | | | | | | −0.0080 | 705 | 838 |
| F | 0.110 | 0.45 | 2.18 | 0.040 | 0.0008 | 0.04 | 0.0029 | 0.035 | 0.005 | | | | | | | −0.0061 | 694 | 816 |
| G | 0.089 | 0.42 | 1.78 | 0.007 | 0.0008 | 0.03 | 0.0035 | 0.057 | 0.012 | | 0.03 | 0.008 | | | | −0.0012 | 701 | 833 |
| H | 0.092 | 1.10 | 1.81 | 0.006 | 0.0030 | 0.05 | 0.0023 | 0.045 | 0.008 | | | | | | | −0.0044 | 715 | 868 |
| I | 0.120 | 1.20 | 1.60 | 0.007 | 0.0009 | 0.06 | 0.0150 | 0.045 | 0.025 | 0.05 | | | | | | −0.0278 | 722 | 880 |
| J | 0.088 | 0.46 | 1.87 | 0.009 | 0.0006 | 0.06 | 0.0800 | 0.030 | 0.008 | | | | 0.0005 | 0.009 | | −0.2672 | 700 | 842 |
| K | 0.090 | 0.80 | 1.83 | 0.007 | 0.0008 | 0.18 | 0.0032 | 0.045 | 0.011 | | | | | | 0.006 | −0.0012 | 708 | 914 |
| L | 0.150 | 0.56 | 1.76 | 0.006 | 0.0008 | 0.05 | 0.0024 | 0.045 | 0.008 | | | | | | | −0.0014 | 704 | 828 |
| M | 0.053 | 0.48 | 1.88 | 0.007 | 0.0005 | 0.04 | 0.0023 | 0.045 | 0.008 | | | | | | | −0.0006 | 701 | 848 |
| N | 0.088 | 1.56 | 1.92 | 0.006 | 0.0009 | 0.05 | 0.0033 | 0.045 | 0.010 | | | | | | | −0.0027 | 724 | 886 |
| O | 0.091 | 0.46 | 2.40 | 0.007 | 0.0008 | 0.03 | 0.0025 | 0.045 | 0.008 | | | | | | | −0.0018 | 691 | 812 |
| P | 0.093 | 0.51 | 1.29 | 0.006 | 0.0008 | 0.05 | 0.0021 | 0.045 | 0.008 | | | | | | | −0.0004 | 712 | 857 |
| Q | 0.102 | 0.51 | 1.71 | 0.007 | 0.0008 | 0.25 | 0.0021 | 0.045 | 0.008 | | | | | | | −0.0004 | 704 | 933 |
| R | 0.095 | 0.51 | 1.76 | 0.007 | 0.0009 | 0.04 | 0.1500 | 0.045 | 0.008 | | | | | | | −0.5076 | 703 | 837 |
| S | 0.083 | 0.45 | 1.88 | 0.007 | 0.0008 | 0.04 | 0.0029 | 0.070 | 0.008 | | | | | | | −0.0031 | 700 | 835 |
| T | 0.090 | 0.48 | 1.88 | 0.007 | 0.0006 | 0.04 | 0.0025 | 0.045 | 0.035 | | | | | | | 0.0255 | 701 | 834 |
| U | 0.090 | 0.48 | 1.88 | 0.007 | 0.0020 | 0.04 | 0.0022 | 0.045 | 0.016 | | | | | | | 0.0055 | 701 | 834 |

*1: [% Ti] − (48/14) [% N] − (48/32) [% S]

TABLE 2

| | | Hot rolling | | | | | | | |
|---|---|---|---|---|---|---|---|---|---|
| No. | Steel type | Slab heating temperature ° C. | *1 | *2 | Slab heating time Time | *3 ° C./second | Finisher delivery temperature ° C. | Coiling temperature ° C. | *4 ° C./second |
| 1 | A | 1150 | 1105 | 1247 | 1.2 | 5 | 880 | 600 | 30 |
| 2 | | 1200 | 1105 | 1247 | 1.2 | 5 | 880 | 600 | 30 |
| 3 | | 1220 | 1105 | 1247 | 1.2 | 5 | 880 | 600 | 30 |
| 4 | | 1200 | 1105 | 1247 | 1.2 | 5 | 880 | 600 | 30 |
| 5 | B | 1050 | 1062 | 1201 | 1.2 | 5 | 880 | 600 | 30 |
| 6 | | 1100 | 1062 | 1201 | 1.2 | 5 | 880 | 600 | 30 |
| 7 | | 1150 | 1062 | 1201 | 1.4 | 5 | 880 | 600 | 30 |
| 8 | | 1200 | 1062 | 1201 | 2.0 | 5 | 880 | 600 | 30 |
| 9 | C | 1250 | 1138 | 1280 | 0.4 | 5 | 880 | 600 | 30 |
| 10 | | 1250 | 1138 | 1280 | 1.2 | 5 | 880 | 600 | 30 |
| 11 | | 1250 | 1138 | 1280 | 2.1 | 5 | 880 | 600 | 30 |
| 12 | | 1250 | 1138 | 1280 | 2.4 | 5 | 880 | 600 | 30 |
| 13 | D | 1220 | 1102 | 1243 | 1.2 | 1 | 880 | 600 | 30 |
| 14 | | 1220 | 1102 | 1243 | 1.4 | 2 | 860 | 600 | 30 |
| 15 | | 1220 | 1102 | 1243 | 1.2 | 5 | 900 | 600 | 30 |
| 16 | | 1220 | 1102 | 1243 | 1.6 | 10 | 880 | 600 | 30 |

TABLE 2-continued

| | | | | | | | | | |
|---|---|---|---|---|---|---|---|---|---|
| 17 | E | 1220 | 1109 | 1250 | 1.2 | 5 | 830 | 600 | 30 |
| 18 | | 1220 | 1109 | 1250 | 1.2 | 5 | 850 | 550 | 30 |
| 19 | | 1220 | 1109 | 1250 | 1.2 | 5 | 880 | 600 | 30 |
| 20 | | 1220 | 1109 | 1250 | 1.2 | 5 | 920 | 630 | 30 |
| 21 | F | 1200 | 1098 | 1239 | 1.2 | 5 | 880 | 480 | 30 |
| 22 | | 1200 | 1098 | 1239 | 1.2 | 5 | 880 | 550 | 30 |
| 23 | | 1200 | 1098 | 1239 | 1.2 | 5 | 880 | 600 | 25 |
| 24 | | 1200 | 1098 | 1239 | 1.2 | 5 | 880 | 670 | 30 |
| 25 | G | 1200 | 1075 | 1215 | 1.2 | 5 | 880 | 600 | 8 |
| 26 | | 1200 | 1075 | 1215 | 1.2 | 5 | 880 | 600 | 15 |
| 27 | | 1200 | 1075 | 1215 | 1.2 | 5 | 880 | 550 | 35 |
| 28 | | 1200 | 1075 | 1215 | 1.2 | 5 | 880 | 600 | 800 |
| 29 | H | 1220 | 1107 | 1248 | 1.2 | 5 | 880 | 600 | 30 |
| 30 | | 1220 | 1107 | 1248 | 1.2 | 5 | 880 | 600 | 60 |
| 31 | | 1220 | 1107 | 1248 | 1.2 | 5 | 880 | 600 | 30 |
| 32 | | 1220 | 1107 | 1248 | 1.2 | 5 | 880 | 600 | 20 |
| 33 | I | 1170 | 1141 | 1283 | 1.2 | 5 | 880 | 600 | 30 |
| 34 | | 1170 | 1141 | 1283 | 1.2 | 5 | 880 | 600 | 30 |
| 35 | | 1170 | 1141 | 1283 | 1.2 | 5 | 880 | 600 | 30 |
| 36 | | 1170 | 1141 | 1283 | 1.2 | 5 | 880 | 600 | 30 |
| 37 | J | 1170 | 1055 | 1194 | 1.2 | 5 | 880 | 600 | 30 |
| 38 | | 1170 | 1055 | 1194 | 1.2 | 5 | 880 | 600 | 30 |
| 39 | | 1170 | 1055 | 1194 | 1.2 | 5 | 880 | 600 | 30 |
| 40 | | 1170 | 1055 | 1194 | 1.2 | 5 | 880 | 600 | 30 |
| 41 | K | 1220 | 1105 | 1247 | 1.2 | 5 | 880 | 600 | 30 |
| 42 | | 1220 | 1105 | 1247 | 1.2 | 5 | 880 | 600 | 30 |
| 43 | | 1220 | 1105 | 1247 | 1.2 | 5 | 880 | 600 | 30 |
| 44 | | 1220 | 1105 | 1247 | 1.2 | 5 | 880 | 600 | 30 |
| 45 | L | 1250 | 1169 | 1312 | 1.2 | 5 | 880 | 600 | 30 |
| 46 | M | 1150 | 1045 | 1184 | 1.2 | 5 | 880 | 600 | 30 |
| 47 | N | 1220 | 1103 | 1244 | 1.2 | 5 | 880 | 600 | 30 |
| 48 | O | 1220 | 1106 | 1247 | 1.2 | 5 | 880 | 600 | 30 |
| 49 | P | 1220 | 1108 | 1249 | 1.2 | 5 | 880 | 600 | 30 |
| 50 | Q | 1250 | 1119 | 1261 | 1.2 | 5 | 880 | 600 | 30 |
| 51 | R | 1220 | 1124 | 1266 | 1.2 | 5 | 880 | 600 | 30 |
| 52 | S | 1250 | 1151 | 1294 | 1.2 | 5 | 880 | 600 | 30 |
| 53 | T | 1220 | 1105 | 1246 | 1.2 | 5 | 880 | 600 | 30 |
| 54 | U | 1220 | 1104 | 1245 | 1.2 | 5 | 880 | 600 | 30 |
| 55 | A | 1200 | 1105 | 1247 | 1.2 | 5 | 880 | 600 | 30 |
| 56 | | 1200 | 1105 | 1247 | 1.2 | 5 | 900 | 600 | 30 |
| 57 | | 1200 | 1105 | 1247 | 1.2 | 5 | 880 | 550 | 30 |
| 58 | B | 1220 | 1062 | 1201 | 1.2 | 5 | 880 | 580 | 30 |

| | | Cold rolling | Annealing condition | | | | |
|---|---|---|---|---|---|---|---|
| No. | Steel type | Reduction ratio % | *5 ° C./second | Annealing temperature ° C. | *6 second | *7 | Remarks |
| 1 | A | 56 | 6 | 800 | 70 | 1980 | Invention Example |
| 2 | | 56 | 6 | 800 | 70 | 1980 | Invention Example |
| 3 | | 56 | 6 | 800 | 70 | 1980 | Invention Example |
| 4 | | 56 | 6 | 800 | 200 | 2469 | Invention Example |
| 5 | B | 56 | 6 | 800 | 160 | 2365 | Comparative Example |
| 6 | | 56 | 6 | 800 | 120 | 2231 | Invention Example |
| 7 | | 56 | 6 | 820 | 70 | 2017 | Invention Example |
| 8 | | 56 | 6 | 800 | 70 | 1980 | Invention Example |
| 9 | C | 56 | 6 | 810 | 70 | 1998 | Comparative Example |
| 10 | | 56 | 6 | 800 | 240 | 2554 | Invention Example |
| 11 | | 56 | 6 | 800 | 120 | 2231 | Invention Example |
| 12 | | 56 | 6 | 800 | 40 | 1719 | Invention Example |
| 13 | D | 56 | 6 | 800 | 70 | 1980 | Comparative Example |
| 14 | | 56 | 6 | 780 | 70 | 1943 | Invention Example |
| 15 | | 56 | 6 | 800 | 70 | 1980 | Invention Example |
| 16 | | 56 | 6 | 800 | 70 | 1980 | Invention Example |
| 17 | E | 56 | 6 | 820 | 70 | 2017 | Comparative Example |
| 18 | | 56 | 6 | 800 | 80 | 2042 | Invention Example |
| 19 | | 56 | 6 | 800 | 70 | 1980 | Invention Example |
| 20 | | 56 | 6 | 800 | 70 | 1980 | Invention Example |
| 21 | F | 56 | 6 | 800 | 70 | 1980 | Invention Example |
| 22 | | 56 | 6 | 790 | 70 | 1961 | Invention Example |
| 23 | | 56 | 6 | 800 | 90 | 2097 | Invention Example |
| 24 | | 56 | 6 | 800 | 70 | 1980 | Comparative Example |
| 25 | G | 56 | 6 | 800 | 70 | 1980 | Comparative Example |
| 26 | | 56 | 6 | 800 | 70 | 1980 | Invention Example |
| 27 | | 56 | 6 | 810 | 70 | 1998 | Invention Example |
| 28 | | 60 | 6 | 800 | 70 | 1980 | Invention Example |
| 29 | H | — | 6 | 800 | 100 | 2146 | Invention Example |
| 30 | | — | 6 | 800 | 70 | 1980 | Invention Example |
| 31 | | 30 | 6 | 760 | 70 | 1906 | Invention Example |

TABLE 2-continued

| | | | | | | | |
|---|---|---|---|---|---|---|---|
| 32 | | 70 | 6 | 850 | 70 | 2072 | Invention Example |
| 33 | I | 56 | 6 | 700 | 240 | 2316 | Comparative Example |
| 34 | | 40 | 6 | 750 | 160 | 2255 | Invention Example |
| 35 | | 50 | 6 | 850 | 104 | 2265 | Invention Example |
| 36 | | 56 | 6 | 910 | 154 | 2588 | Comparative Example |
| 37 | J | 56 | 6 | 800 | 20 | 1396 | Comparative Example |
| 38 | | 56 | 6 | 820 | 40 | 1751 | Invention Example |
| 39 | | 56 | 6 | 800 | 39600 | 4933 | Invention Example |
| 40 | | 56 | 6 | 860 | 86400 | 5593 | Comparative Example |
| 41 | K | 56 | 10 | 800 | 70 | 1980 | Comparative Example |
| 42 | | 56 | 7 | 800 | 70 | 1980 | Invention Example |
| 43 | | 56 | 4 | 800 | 70 | 1980 | Invention Example |
| 44 | | 56 | 1 | 800 | 60 | 1908 | Invention Example |
| 45 | L | 56 | 6 | 800 | 70 | 1980 | Comparative Example |
| 46 | M | 56 | 6 | 800 | 70 | 1980 | Comparative Example |
| 47 | N | 56 | 6 | 800 | 70 | 1980 | Comparative Example |
| 48 | O | 56 | 6 | 800 | 70 | 1980 | Comparative Example |
| 49 | P | 56 | 6 | 800 | 80 | 2042 | Comparative Example |
| 50 | Q | 56 | 6 | 800 | 70 | 1980 | Comparative Example |
| 51 | R | 56 | 6 | 800 | 100 | 2146 | Comparative Example |
| 52 | S | 56 | 6 | 800 | 70 | 1980 | Comparative Example |
| 53 | T | 56 | 6 | 800 | 70 | 1980 | Comparative Example |
| 54 | U | 56 | 6 | 820 | 70 | 2017 | Comparative Example |
| 55 | A | 56 | 6 | 820 | 70 | 2017 | Invention Example |
| 56 | | 56 | 6 | 800 | 70 | 1980 | Invention Example |
| 57 | | 56 | 6 | 800 | 70 | 1980 | Invention Example |
| 58 | B | 56 | 6 | 820 | 70 | 2017 | Comparative Example |

*1: Lower limit of the slab heating temperature calculated from formula (2)
*2: Upper limit of the slab heating temperature calculated from formula (2)
*3: Average cooling rate from the slab heating temperature to the rolling start temperature
*4: Average cooling rate from the finisher delivery temperature to the coiling temperature
*5: Average raising temperature from 600° C. to 700° C.
*6: Hold time (t) at the annealing temperature (AT)
*7: (AT + 273) × logt 2. Evaluation Methods Steel microstructures of the steel sheets obtained under various manufacturing conditions were analyzed to investigate the microstructure proportion, and were subjected to tensile test to evaluate tensile properties including tensile strength. Methods for the individual evaluations are as follows.

(Area Fractions of Ferrite, Martensite, and Non-Recrystallized Ferrite)

Test specimens were sampled individually at a front end part, a center part, and a rear end part in the longitudinal direction (rolling direction) of the steel sheet, in the rolling direction, and the L cross-sections taken in the thickness direction and in parallel to the rolling direction were mirror polished. The front end part, the center part, and the rear end part in the longitudinal direction (rolling direction) of the steel sheet, where the test specimens of the steel sheets were sampled, individually located at the center in the width direction. The cross-sections taken in the thickness direction were etched with nital solution to expose the microstructure, and then observed under a scanning electron microscope (SEM). The area fractions of ferrite, martensite, and non-recrystallized ferrite were examined by the point counting method, according to which a 16×15 mesh with a 4.8 μm interval was overlaid on a 82 μm×57 μm area in actual length in a 1500×SEM image, and the number of mesh points that fall in the individual phases were counted. Each area fraction was determined by an average value of three area fraction values obtained from independent 1500×SEM images. The area fractions of ferrite and martensite in accordance with aspects of the present invention were given by values determined at the center part in the longitudinal direction of the steel sheet. The area fraction of non-recrystallized ferrite was given by difference between the maximum value and the minimum value of the measured values obtained at the three points, which are the front end part, the center part, and the rear end part. Ferrite and non-recrystallized ferrite microstructures are black, and martensite microstructure is white. The non-recrystallized ferrite has, in the crystal grain thereof, subboundaries which are white.

The area fraction of the balance, other than ferrite and martensite, was calculated by subtracting the total area fraction of ferrite and martensite, from 100%. In accordance with aspects of the present invention, the balance was considered to represent the total area fraction of pearlite, bainite, and retained austenite. The area fraction of the balance is given in the column titled "Others" in Table 3.

Note that the measurement at the front end part in the longitudinal direction of the steel sheet was conducted at a position 1 m from the front end towards the center part. On the other hand, the measurement at the rear end part in the longitudinal direction of the steel sheet was conducted at a position 1 m from the rear end towards the center part.

In accordance with aspects of the present invention, difference between the maximum value and the minimum value out of the area fraction values of non-recrystallized ferrite, individually measured at the front end part, the center part, and the rear end part in the longitudinal direction (rolling direction) of the steel sheet, was referred to as "difference between the maximum value and the minimum value of the area fraction of non-recrystallized ferrite in the longitudinal direction of the steel sheet".

The coiling temperature tends to become highest and the cooling rate after coiling tends to become slowest at the center part in the longitudinal direction of the steel sheet; meanwhile the coiling temperature tends to become lowest and the cooling rate tends to become fastest at the front end part and the rear end part in the longitudinal direction of the steel sheet. Hence, the fine precipitate tends to become scarcest at the center part in the longitudinal direction of the steel sheet, and non-recrystallized ferrite tends to become scarcest. Meanwhile, the fine precipitate tends to become most abundant at the front end part and the rear end part in the longitudinal direction of the steel sheet, and non-recrystallized ferrite tends to become most abundant. Hence, the measured value obtained at the front end part or rear end part in the longitudinal direction of the steel sheet, whichever is larger, was assumed as the maximum value. Meanwhile, the measured value obtained at the center part in the longitudinal direction of the steel sheet was assumed as the minimum value. Hence in accordance with aspects of the present invention, the difference between the maximum value and the minimum value of the area fraction of non-recrystallized ferrite in the longitudinal direction of the steel sheet, may be given by difference between the maximum value and the minimum value out of the measured values obtained at three points, which are the front end part, the center part, and the rear end part in the longitudinal direction (rolling direction) of the steel sheet.

(Tensile Test)

JIS No. 5 specimens with a gauge length of 50 mm and a width of the section between gauge marks of 25 mm were sampled from the individual steel sheets in the direction vertical to the rolling direction, and subjected to tensile test at a tensile speed of 10 mm/min, in compliance with the requirements of JIS Z 2241 (2011). Tensile strength (denoted as TS in Table 3), and yield strength (denoted as YS in Table 3) were measured by the tensile test. Note that the tensile strength (TS) and the yield strength (YS) summarized in Table 3 are values obtained by measuring each specimen sampled from the steel sheet at the center part both in the longitudinal direction (rolling direction) and in the width direction.

(Material Uniformity)

The aforementioned tensile test was conducted individually at the front end part, the center part, and the rear end part in the longitudinal direction of the steel sheet, and material uniformity was evaluated on the basis of difference (denoted as ΔYR in Table 3) between the maximum value and the minimum value out from the measured values of yield ratio (YR) at these three parts. The yield ratio (YR) was calculated by dividing YS by TS. Note that the measurements at the front end part, the center part, and the rear end part in the longitudinal direction of the steel sheet were individually conducted at the center part in the width direction. The measurement in accordance with aspects of the present invention at the front end part in the longitudinal direction of the steel sheet was conducted at a position 1 m from the front end towards the center part. On the other hand, the measurement in accordance with aspects of the present invention at the rear end part in the longitudinal direction of the steel sheet was conducted at a position 1 m from the rear end towards the center part.

3. Evaluation Results

Evaluation results are summarized in Table 3.

TABLE 3

| | | Microstructure | | | | | Mechanical property | | | |
|---|---|---|---|---|---|---|---|---|---|---|
| No. | Steel type | α % | *1 % | M % | Others % | *2 % | YS MPa | TS MPa | ΔYR | Remarks |
| 1 | A | 71 | 3 | 24 | 5 | 3 | 498 | 638 | 0.02 | Invention Example |
| 2 | | 73 | 3 | 26 | 1 | 2 | 503 | 645 | 0.01 | Invention Example |
| 3 | | 72 | 3 | 23 | 5 | 3 | 509 | 636 | 0.02 | Invention Example |
| 4 | | 72 | 3 | 27 | 1 | 0 | 492 | 645 | 0.02 | Invention Example |
| 5 | B | 75 | 14 | 20 | 5 | 7 | 466 | 602 | 0.07 | Comparative Example |
| 6 | | 78 | 8 | 20 | 2 | 2 | 454 | 602 | 0.05 | Invention Example |
| 7 | | 79 | 7 | 21 | 0 | 1 | 462 | 604 | 0.02 | Invention Example |
| 8 | | 75 | 4 | 18 | 7 | 2 | 471 | 601 | 0.00 | Invention Example |
| 9 | C | 59 | 12 | 39 | 2 | 8 | 545 | 724 | 0.07 | Comparative Example |
| 10 | | 58 | 3 | 40 | 2 | 4 | 545 | 722 | 0.02 | Invention Example |
| 11 | | 58 | 2 | 40 | 2 | 2 | 535 | 721 | 0.03 | Invention Example |
| 12 | | 60 | 2 | 40 | 0 | 2 | 478 | 725 | 0.02 | Invention Example |
| 13 | D | 65 | 12 | 33 | 2 | 6 | 564 | 705 | 0.08 | Comparative Example |
| 14 | | 65 | 9 | 35 | 0 | 3 | 539 | 706 | 0.05 | Invention Example |
| 15 | | 62 | 2 | 36 | 2 | 2 | 552 | 699 | 0.02 | Invention Example |
| 16 | | 60 | 2 | 34 | 6 | 2 | 551 | 697 | 0.02 | Invention Example |
| 17 | E | 83 | 8 | 17 | 0 | 6 | 451 | 596 | 0.06 | Comparative Example |
| 18 | | 81 | 5 | 17 | 2 | 5 | 454 | 592 | 0.05 | Invention Example |
| 19 | | 82 | 5 | 14 | 4 | 2 | 453 | 593 | 0.02 | Invention Example |
| 20 | | 80 | 5 | 13 | 7 | 1 | 451 | 591 | 0.05 | Invention Example |
| 21 | F | 50 | 7 | 43 | 7 | 2 | 557 | 823 | 0.02 | Invention Example |
| 22 | | 54 | 2 | 45 | 1 | 1 | 642 | 827 | 0.02 | Invention Example |
| 23 | | 54 | 2 | 46 | 0 | 2 | 653 | 826 | 0.03 | Invention Example |
| 24 | | 51 | 7 | 46 | 3 | 8 | 634 | 824 | 0.06 | Comparative Example |
| 25 | G | 75 | 6 | 24 | 1 | 10 | 498 | 630 | 0.11 | Comparative Example |
| 26 | | 75 | 4 | 23 | 2 | 4 | 484 | 629 | 0.05 | Invention Example |
| 27 | | 75 | 4 | 23 | 2 | 2 | 499 | 630 | 0.03 | Invention Example |
| 28 | | 72 | 4 | 24 | 4 | 2 | 501 | 626 | 0.03 | Invention Example |
| 29 | H | 70 | 3 | 30 | 0 | 4 | 512 | 648 | 0.02 | Invention Example |
| 30 | | 68 | 1 | 31 | 1 | 4 | 520 | 650 | 0.01 | Invention Example |
| 31 | | 80 | 3 | 17 | 3 | 2 | 483 | 649 | 0.02 | Invention Example |
| 32 | | 35 | 3 | 60 | 5 | 2 | 580 | 748 | 0.03 | Invention Example |
| 33 | I | 97 | 12 | 3 | 0 | 6 | 407 | 595 | 0.06 | Comparative Example |
| 34 | | 91 | 7 | 9 | 0 | 4 | 424 | 601 | 0.03 | Invention Example |
| 35 | | 69 | 2 | 31 | 0 | 2 | 475 | 647 | 0.03 | Invention Example |
| 36 | | 28 | 11 | 65 | 7 | 7 | 487 | 745 | 0.07 | Comparative Example |
| 37 | J | 65 | 11 | 29 | 6 | 8 | 456 | 659 | 0.07 | Comparative Example |
| 38 | | 68 | 4 | 29 | 3 | 3 | 511 | 660 | 0.03 | Invention Example |
| 39 | | 68 | 4 | 32 | 0 | 5 | 517 | 663 | 0.03 | Invention Example |

TABLE 3-continued

| No. | Steel type | Microstructure α % | *1 % | M % | Others % | *2 % | Mechanical property YS MPa | TS MPa | ΔYR | Remarks |
|---|---|---|---|---|---|---|---|---|---|---|
| 40 | | 68 | 11 | 31 | 1 | 9 | 449 | 661 | 0.09 | Comparative Example |
| 41 | K | 67 | 13 | 31 | 2 | 8 | 504 | 650 | 0.07 | Comparative Example |
| 42 | | 67 | 7 | 29 | 4 | 3 | 487 | 646 | 0.02 | Invention Example |
| 43 | | 69 | 2 | 28 | 3 | 2 | 488 | 647 | 0.00 | Invention Example |
| 44 | | 89 | 2 | 11 | 0 | 2 | 411 | 621 | 0.02 | Invention Example |
| 45 | L | 47 | 14 | 48 | 5 | 2 | 663 | 826 | 0.07 | Comparative Example |
| 46 | M | 79 | 3 | 19 | 2 | 1 | 460 | 576 | 0.02 | Comparative Example |
| 47 | N | 60 | 11 | 40 | 0 | 6 | 521 | 677 | 0.06 | Comparative Example |
| 48 | O | 37 | 12 | 59 | 4 | 6 | 656 | 853 | 0.07 | Comparative Example |
| 49 | P | 65 | 2 | 11 | 24 | 0 | 326 | 469 | 0.02 | Comparative Example |
| 50 | Q | 69 | 11 | 31 | 0 | 4 | 436 | 639 | 0.06 | Comparative Example |
| 51 | R | 70 | 13 | 29 | 1 | 7 | 498 | 639 | 0.07 | Comparative Example |
| 52 | S | 67 | 12 | 31 | 2 | 6 | 520 | 651 | 0.06 | Comparative Example |
| 53 | T | 61 | 12 | 36 | 3 | 8 | 521 | 668 | 0.08 | Comparative Example |
| 54 | U | 60 | 14 | 36 | 4 | 9 | 534 | 668 | 0.07 | Comparative Example |
| 55 | A | 64 | 2 | 30 | 6 | 3 | 501 | 635 | 0.02 | Invention Example |
| 56 | | 71 | 2 | 28 | 1 | 3 | 513 | 651 | 0.02 | Invention Example |
| 57 | | 64 | 3 | 27 | 9 | 3 | 498 | 640 | 0.02 | Invention Example |
| 58 | B | 76 | 5 | 19 | 5 | 7 | 465 | 612 | 0.06 | Comparative Example |

α: Area fraction of ferrite,
M: Area fraction of martensite
Others: Total area fraction of perlite, bainite, and retained austenite
*1: Area fraction of non-recrystallized ferrite relative to entire microstructure
*2: Difference between maximum value and minimum value of area fraction of non-recrystallized ferrite in longitudinal direction of steel sheet In this embodiment, the steel sheets with a TS of 590 MPa or larger and a ΔYR of 0.05 or smaller were judged to be acceptable, and listed as inventive examples in Table 3. In contrast, the steel sheets that do not satisfy at least one of these requirements were judged to be rejected, and listed as comparative example in Table 3.

Example 2

No. 1 steel sheet of Example 1, listed in Table 3, was formed by pressing, to manufacture a member of this invention example. Further, No. 1 steel sheet of Example 1 listed in Table 3, and No. 2 steel sheet of Example 1 listed in Table 3 were welded by spot welding, to manufacture a member of this invention example. It was confirmed that, since the high strength steel sheet of this invention example is well balanced between high strength and material uniformity, the high strength member obtained with use of the high strength steel sheet of this invention example can keep good shape of parts, and that the steel sheet is suitably applicable to automotive structural member.

The invention claimed is:

1. A high strength steel sheet having a tensile strength of 590 MPa or larger and a chemical composition in mass % containing:

C: 0.06% or more and 0.14% or less,
Si: 0.1% or more and 1.5% or less,
Mn: 1.4% or more and 2.2% or less,
P: 0.05% or less,
S: 0.0050% or less,
Al: 0.01% or more and 0.20% or less,
N: 0.10% or less,
Nb: 0.015% or more and 0.060% or less, and
Ti: 0.001% or more and 0.030% or less, optionally containing one or more of following (A) to (C);
(A) one of, or two or more of
Cr: 0.01% or more and 0.15% or less,
Mo: 0.01% or more and less than 0.10%, and
V: 0.001% or more and 0.065% or less,
(B) B: 0.0001% or more and less than 0.002%,
(C) one of or two of
Cu: 0.001% or more and 0.2% or less, and
Ni: 0.001% or more and 0.1% or less,
contents of S, N and Ti satisfying Formula (1) below,
a balance being Fe and an inevitable impurity,
comprising, in terms of area fraction relative to an entire steel microstructure, 30% or more and 100% or less ferrite, 0% or more and 70% or less martensite, and less than 20% in total of pearlite, bainite and retained austenite, and the ferrite containing, in terms of area fraction relative to an entire microstructure, 0% or more and 10% or less non-recrystallized ferrite, with a difference between a maximum value and a minimum value of the area fraction of the non-recrystallized ferrite in a longitudinal direction of the steel sheet of 5% or below:

$$[\%\ Ti]-(48/14)[\%\ N]-(48/32)[\%\ S]\leq 0, \qquad \text{Formula (1):}$$

in Formula (1), [% Ti] represents content (mass %) of component element Ti, [% N] represents content (mass %) of component element N, and [% S] represents content (mass %) of component element S.

2. The high strength steel sheet according to claim 1, having a plating layer on a surface the steel sheet.

3. A high strength member comprising the high strength steel sheet according to claim 1 subjected to at least either forming or welding.

4. A high strength member comprising the high strength steel sheet according to claim 2 subjected to at least either forming or welding.

5. A method for manufacturing a high strength steel sheet according to claim 1, comprising: a hot rolling process in which a steel slab having the chemical composition is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to 650° C. or lower at an average cooling rate of 10° C./sec or faster, and then coiled at 650° C. or lower; and an annealing process in which the hot rolled steel sheet obtained in the hot rolling process is heated up to an annealing temperature which is $A_{C1}$ transformation temperature or higher and ($A_{C3}$ transformation temperature+20° C.) or lower, at an average heating rate from 600° C. to 700° C. of 8° C./sec or slower, held at the annealing temperature for a hold time t (second) that satisfies Formula (3) below, and then cooled:

$$0.80\times(2.4-6700/T)\leq\log\{[\%\ Nb]\times([\%\ C]+12/14[\%\ N])\}\leq 0.65\times(2.4-6700/T) \quad \text{Formula (2):}$$

in Formula (2), T represents heating temperature (° C.) of the steel slab, [% Nb] represents content (mass %) of component element Nb, [% C] represents content (mass %) of component element C, and [% N] represents content (mass %) of component element N; and $$1500\leq(AT+273)\times\log t<5000 \quad \text{Formula (3):}$$

in Formula (3), AT represents annealing temperature (° C.), and t represents hold time (second) at the annealing temperature.

6. A method for manufacturing a high strength steel sheet according to claim 1, comprising: a hot rolling process in which a steel slab having the chemical composition is heated at a heating temperature T (° C.) that satisfies Formula (2) below for 1.0 hour or longer, then cooled from the heating temperature down to a rolling start temperature at an average cooling rate of 2° C./sec or faster, then finish rolled at a finisher delivery temperature of 850° C. or higher, then cooled from the finisher delivery temperature down to 650° C. or lower at an average cooling rate of 10° C./sec or faster, and then coiled at 650° C. or lower;

a cold rolling process in which the hot rolled steel sheet obtained in the hot rolling process is cold-rolled; and an annealing process in which the cold rolled steel sheet obtained in the cold rolling process is heated up to an annealing temperature which is $A_{C1}$ transformation temperature or higher and ($A_{C3}$ transformation temperature+20° C.) or lower, at an average heating rate from 600° C. to 700° C. of 8° C./sec or slower, held at the annealing temperature for a hold time t (second) that satisfies Formula (3) below, and then cooled:

$$0.80\times(2.4-6700/T)\leq\log\{[\%\ Nb]\times([\%\ C]+12/14[\%\ N])\}\leq 0.65\times(2.4-6700/T) \quad \text{Formula (2):}$$

in Formula (2), T represents heating temperature (° C.) of the steel slab, [% Nb] represents content (mass %) of component element Nb, [% C] represents content (mass %) of component element C, and [% N] represents content (mass %) of component element N; and $$1500\leq(AT+273)\times\log t<5000 \quad \text{Formula (3):}$$

in Formula (3), AT represents annealing temperature (° C.), and t represents hold time (second) at the annealing temperature.

7. The method for manufacturing a high strength steel sheet according to claim 5, further comprising a plating process for providing plating, following the annealing process.

8. The method for manufacturing a high strength steel sheet according to claim 6, further comprising a plating process for providing plating, following the annealing process.

9. A method for manufacturing a high strength member, comprising subjecting the high strength steel sheet manufactured by the method for manufacturing a high strength steel sheet according to claim 5, to at least either forming or welding.

10. A method for manufacturing a high strength member, comprising subjecting the high strength steel sheet manufactured by the method for manufacturing a high strength steel sheet according to claim 6, to at least either forming or welding.

11. A method for manufacturing a high strength member, comprising subjecting the high strength steel sheet manufactured by the method for manufacturing a high strength steel sheet according to claim 7, to at least either forming or welding.

12. A method for manufacturing a high strength member, comprising subjecting the high strength steel sheet manufactured by the method for manufacturing a high strength steel sheet according to claim 8, to at least either forming or welding.

* * * * *